United States Patent [19]

Andreas et al.

[11] Patent Number: 5,034,234

[45] **Date of Patent: * Jul. 23, 1991**

[54] MICROWAVE HEATING AND SERVING PACKAGE

[75] Inventors: David W. Andreas, Minneapolis; Richard D. Stevens, Wayzata, both of Minn.

[73] Assignee: Golden Valley Microwave Foods Inc., Edina, Minn.

[ * ] Notice: The portion of the term of this patent subsequent to Jul. 24, 2007 has been disclaimed.

[21] Appl. No.: 436,366

[22] Filed: Nov. 14, 1989

Related U.S. Application Data

[63] Continuation-in-part of Ser. No. 169,215, Mar. 15, 1988, Pat. No. 4,943,439.

[51] Int. Cl.[5] ..... B65D 81/34; A23L 1/025; H05B 6/80

[52] U.S. Cl. ..... 426/107; 99/DIG. 14; 206/611; 219/10.55 E; 219/10.55 F; 229/120.34; 229/903; 426/113

[58] Field of Search ..... 426/107, 113, 234, 243; 219/10.55 E, 10.55 F; 99/DIG. 14; 206/611; 229/903, 120.34, 117.12

[56] References Cited

U.S. PATENT DOCUMENTS

| | | | |
|---|---|---|---|
| 2,865,768 | 12/1958 | Barnes et al. | 99/171 |
| 2,917,218 | 12/1959 | Guyer | 229/23 |
| 2,963,198 | 12/1960 | Foster et al. | 229/117.12 |
| 3,027,062 | 3/1962 | Huss | 229/23 |
| 3,300,115 | 1/1967 | Schauer | 206/611 |
| 3,325,003 | 6/1967 | Bilezerian | 206/611 |
| 3,411,696 | 11/1968 | Gyer et al. | 206/491 |
| 3,425,845 | 2/1969 | Dunn | 99/171 |
| 3,483,358 | 12/1969 | Elslew | 219/385 |
| 3,891,775 | 6/1975 | Murray et al. | 246/107 |
| 3,943,320 | 3/1976 | Bowen | 219/10.55 E |
| 4,036,423 | 7/1977 | Gordon | 229/43 |
| 4,190,757 | 2/1980 | Turpin et al. | 219/10.55 E |
| 4,196,331 | 4/1980 | Leveckis | 219/10.55 E |
| 4,230,924 | 10/1980 | Brastad | 219/10.55 E |
| 4,267,420 | 5/1981 | Brastad | 219/10.55 |
| 4,319,680 | 3/1982 | Hiemstra | 229/120.34 |
| 4,470,538 | 9/1984 | Heathcock | 229/23 R |
| 4,474,324 | 10/1984 | Forbes | 229/23 BT |
| 4,555,605 | 11/1985 | Brown et al. | 219/10.55 E |
| 4,589,553 | 5/1986 | Ferrero | 206/525 |
| 4,590,349 | 5/1986 | Brown et al. | 219/10.55 E |
| 4,594,492 | 6/1986 | Marvoszitz | 219/10.55 E |
| 4,612,431 | 9/1986 | Brown et al. | 219/10.55 E |
| 4,626,641 | 12/1986 | Brown et al. | 219/10.55 E |
| 4,641,005 | 2/1987 | Sieferth | 426/107 |
| 4,777,053 | 10/1988 | Tobelmann et al. | 426/107 |
| 4,780,587 | 10/1988 | Brown | 426/107 |
| 4,794,005 | 12/1988 | Swiontek | 426/107 |
| 4,870,233 | 9/1989 | McDonald et al. | 99/DIG. 14 |
| 4,876,427 | 10/1989 | Mode | 426/107 |

*Primary Examiner*—Peter Kratz
*Attorney, Agent, or Firm*—James V. Harmon

[57] ABSTRACT

A food heating and serving package for elongated food products such as french fries and fish sticks is described which includes partitions formed from microwave energy absorbing material positioned in parallel relationship to define a honeycomb-like array of cells, each adapted to receive one of the food sticks and to crisp, toast or brown the surface of the food sticks. The partitions preferably enclose and heat the food sticks on at least three sides. A pair of opposed retaining tabs lock the susceptor in place within the package with a wedging action. The package includes a removable upper portion connected to a bottom portion with a severable panel. When the bottom portion is removed the food sticks slide out of the cells within which they are held in place within the top portion of the package. The back panel of the package has an upwardly extending portion which serves as a carrying handle to facilitate safe removal from the oven after heating.

7 Claims, 4 Drawing Sheets

MICROWAVE HEATING AND SERVING PACKAGE

This is a continuation-in-part of application Ser. No. 169,215 filed Mar. 15, 1988, now U.S. Pat. No. 4,943,439.

FIELD OF THE INVENTION

The present invention relates to packages for heating foods in a microwave oven.

BACKGROUND OF THE INVENTION

A variety of susceptors have been previously proposed for absorbing microwave energy and transmitting it by conduction to crisp and brown the surface of the food product. Some prior susceptors were stiff, brittle, subject to breakage or otherwise unsuited for use in lightweight, disposable and low cost packaging. In other cases the susceptor, while interacting with the microwave energy present in an oven, does not adequately heat or crisp the food product. Other susceptors heat only one side of the food product. So, for example, if the food product is rectangular in shape, two or three sides remain pale and uncrispened. The susceptor itself should be easy to insert into the package and be held securely in place. The hot package should also be easy to remove from the oven without burning the fingers.

It has been found that when a food product such as a french fried potato is placed in an ordinary paper carton and heated in a microwave oven, the potato becomes soggy. This occurs even if an effort is made to allow steam to escape through openings at the top of the package. As a result, attempts have been made to develop a more effective susceptor for lining food cartons to augment the heat provided by direct microwave interaction with the food. For example, U.S. Pat. Nos. 4,612,431 and 4,735,513 describe a susceptor formed from polyester film to which a thin, semiconductive layer of metal is applied. These laminates are bonded, for example, to two opposing walls of the package for absorbing microwave energy and then transfering it to the food product. Tests conducted in the development of the present invention show, however, that these laminates and the resulting packages are not effective in crisping, browning or toasting the surface of a food such as a french fried potato. After heating, the product still tends to be perceived as somewhat moist, limp and soggy. A major objective of the invention is therefore to provide a microwave susceptor package that will crisp, toast or brown several surfaces of a stick-shaped food product such as french fried potatoes, fish sticks or the like so that the food is perceived to be crisp and appetizing to the consumer.

Other attempts have been made to deal with this problem. For example, U.S. Pat. Nos. 4,267,420 and 4,230,924 provide a lightweight flexible wrapper formed from a laminate composed of a flexible sheet material that interacts with microwave energy. One major shortcoming is that the food sticks have to be individually wrapped and later unwrapped one-by-one by the customer. Another problem results from the fact that portions of the sheet material will shrivel, shrink, split and crack, particularly in areas where it is folded or not in contact with the food.

SUMMARY OF THE INVENTION

The present invention provides a food package containing a microwave interactive susceptor which is self-supporting and contains a self-supporting honeycomb-like arrangement of heating compartments, each partially or completely enclosing a food product. More specifically, each food piece is enclosed within a compartment including susceptor material on more than two sides. It is preferred that the susceptor material enclose the food piece on all sides. For example, a finished heating package can contain self-supporting, open-ended compartments having parallel walls or partitions spaced apart from one another and extending along the length of the package in parallel relationship. This provides a plurality of elongated openings between the partitions, each receiving one food piece. In one form of the invention the package includes several partitioned trays formed from microwave interactive laminated sheet material. Each tray can be made from a lamination comprising metallized polyester adhesively bonded between two paper sheets or to a single paper sheet. For example, the metallized polyester sheet or a sheet containing other microwave interactive material which becomes hot in a microwave oven such as a mineral, metal oxide, salt, carbon or the like, can be bonded between a sheet of greaseproof paper and a sheet of kraft paper. This laminate is then formed into a tray having a plurality of laterally spaced apart parallel folds, flutes or pleats defining self-supporting partitions that run parallel to each other to form the honeycomb-like array of parallel chambers for loosely holding the food pieces so that the food pieces can be dropped into and later slid out of the chambers in an endwise direction. In a preferred form, each chamber conforms generally to the surface of the food product. In this case the food product has a rectangular cross section; thus, each chamber has a flat bottom and parallel upstanding side walls which intersect the bottom at right angles to act as partitions.

The invention preferably includes a stack of such trays to provide a heating susceptor surface on all four sides of each food piece. Opposed locking tabs engage the trays along opposite edges to hold them in place with a wedging action. The carton preferably has separate upper and lower portions that are telescopically related. The top portion contains the heating trays. After heating, when the top portion of the carton is removed, the food products slide out of the compartments into the bottom portion of the carton which then functions as a serving dish from which the food can be directly eaten.

The invention will now be described by way of example with reference to the accompanying figures which illustrate but a few of the various ways in which the present invention can be practiced within the scope of the appended claims.

THE FIGURES

DESCRIPTION OF A PREFERRED EMBODIMENT

Figure 1:
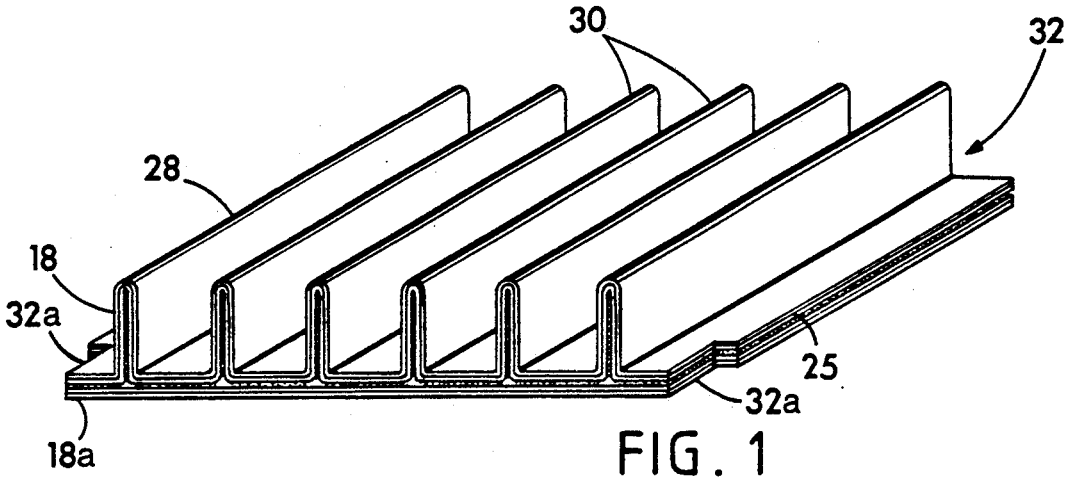
FIG. 1 is an enlarged, semi-diagrammatic perspective view showing one form of food heating tray in accordance with the invention.

FIGS. 1–4 show microwave heating trays 32 comprising a susceptor laminate or sheet 18 in accordance with the present invention. Each susceptor is composed of three separate sheets laminated together and including an inner sheet of paper 20 facing the food, an outer sheet of paper 22 and a sheet of flexible plastic 24 such as polyester film which serves as a backing for a microwave interactive coating 26, e.g. a semiconductive metallic coating 26 formed from aluminum or other metal deposited by vacuum metallization and transmitting about 40% to 60% of incident light. The metal can be coated on a base sheet comprising a 2 mil polyester film 24. The metal coating 26 is semiconductive so that it will interact with the microwave energy in a microwave oven to absorb a portion of the microwave energy, converting it to heat. Other known coatings or substances that will become hot in a microwave oven can be used in place of the metal coating if desired. Layer 22 can be eliminated from sheet 18 if desired for some applications. Layer 18*a* can also be eliminated for some applications. In that event, the tray 32 will consist of a single sheet 18 composed of a layer of paper 20, glue 25 and a microwave reactive layer (sheet 24 and coating 26).

Figure 2:
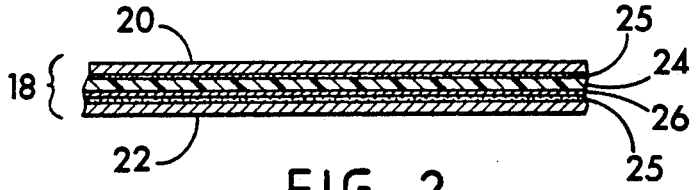
FIG. 2 is a microscopic cross-sectional view of the tray of FIG. 1.

The laminate 18 is folded into a plurality of vertically extending flutes or pleats 28 in which the sheet is folded against itself. Those layers of the folded pleats in contact with each other are bonded by adhesive to form parallel longitudinally extending self-supporting dividers or partitions 30. The upper laminate 18 is itself laminated with adhesive to a lower three-layer sheet 18*a* which has the same composition as sheet 18 but has no folds. The various sheets, e.g. flutes or pleats 28, of each of the laminates 18 or 18*a* can be bonded together with a polyvinylacetate emulsion type adhesive 25 (FIG. 2). The upper and lower sheets 18 and 18*a* can be bonded together with the same adhesive 25. While a variety of paper sheets can be used, sheet 20 can comprise 25-pound greaseproof paper and sheet 22 can comprise 30-pound kraft paper. The laminate 18*a* can be similarly constructed with a layer of paper on opposite sides of sheet 24.

Figure 3:
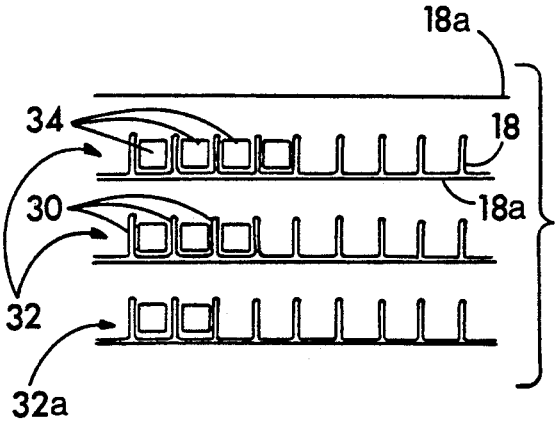
FIG. 3 is an exploded end view of a stack of trays in accordance with the invention.

In FIG. 3 is shown a stack of laminated trays 32 formed from bonded laminates 18 and 18*a* in which are placed food pieces such as french fry sticks or fish sticks 34, each within one of the enclosures between the partitions 30. It will thus be seen that with the stack assembled as shown in FIG. 3 all four major surfaces of the food pieces 34 are exposed to one of the microwave interactive susceptor sheets 18, 18*a* and all surfaces will therefore be browned, toasted or crisped during the heating process. The susceptor sheets, it has been found, must touch or almost touch the surface of the food to achieve a crisping or toasting effect. This makes otherwise unappealing french fries or fish sticks appetizing. The invention can be used with a variety of other vegetables and meat based foods such as bread sticks, carrot sticks, soft pretzels, batter coated vegetables such as tempura, as well as corn dogs or other dough wrapped meat products.

Figure 5:
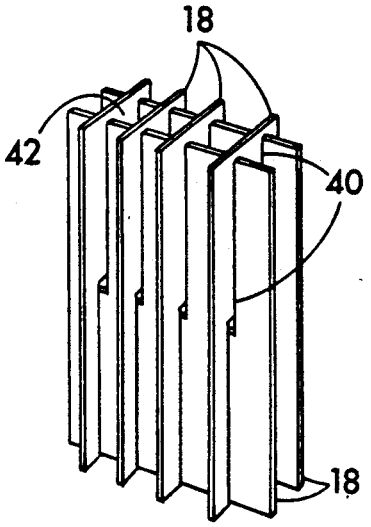
FIG. 5 is a perspective view of laminates in accordance with another form of the invention.

Refer now to FIG. 5 which illustrates a modified form of the invention. As shown in FIG. 5 the microwave interactive sheets 18 are provided with partial longitudinally extending cuts or slits 40. In this way a first group of parallel sheets 18 are interlocked with a second group of parallel sheets 18 by sliding them together in a vertical direction as shown to provide longitudinally extending parallel elongated compartments between the mutually perpendicular sets of microwave interactive partitions. Food products are placed in the compartments 42 between the partitions which function to crisp the food pieces during microwave heating as described above.

Figure 6:
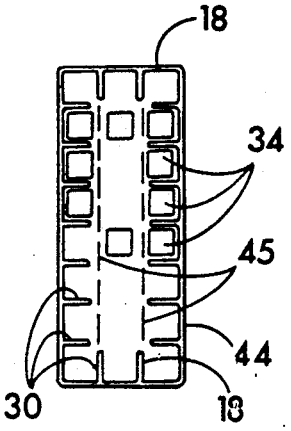
FIG. 6 is a cross-sectional view of laminates formed into a package in accordance with another embodiment of the invention.
Figure 7:
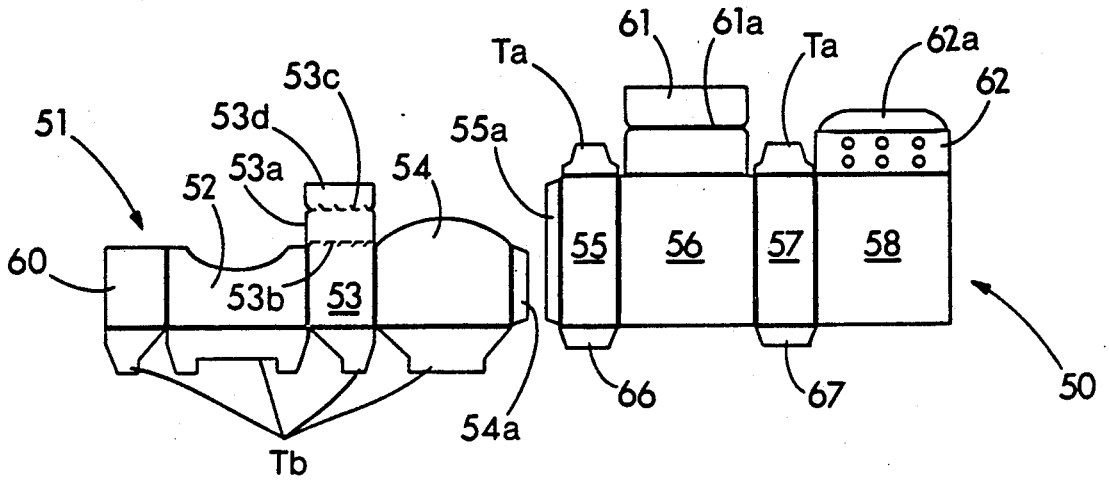
FIG. 7 shows a plan view of one form of two carton blanks that can be employed together to provide a carton of the invention.

Refer now to FIG. 6 which illustrates another embodiment of the invention. As seen in FIG. 6 the laminated sheet 18 comprises a single sheet lining an entire package 44 so that the necessity of handling separate trays is not necessary. Instead, the sheet 18 is simply bonded to the inside surface of the package 44 which when assembled will then include a plurality of parallel, centrally projecting partitions 30 that form enclosures for the food pieces 34 which are supported loosely inside so that they can be easily removed by sliding out of the ends of the package after it is opened as in FIGS. 1–5. In this case separate trays are not needed. If desired, flat sheets 45 can be inserted into the package 44 on opposite sides of a center row of food pieces, if present, to heat their surfaces.

Figure 8:
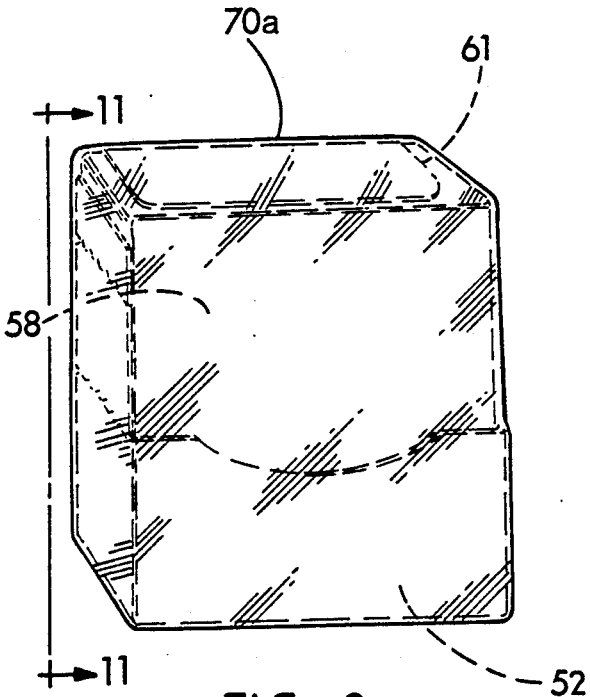
FIG. 8 is a perspective view of the carton prior to being opened.
Figure 9:
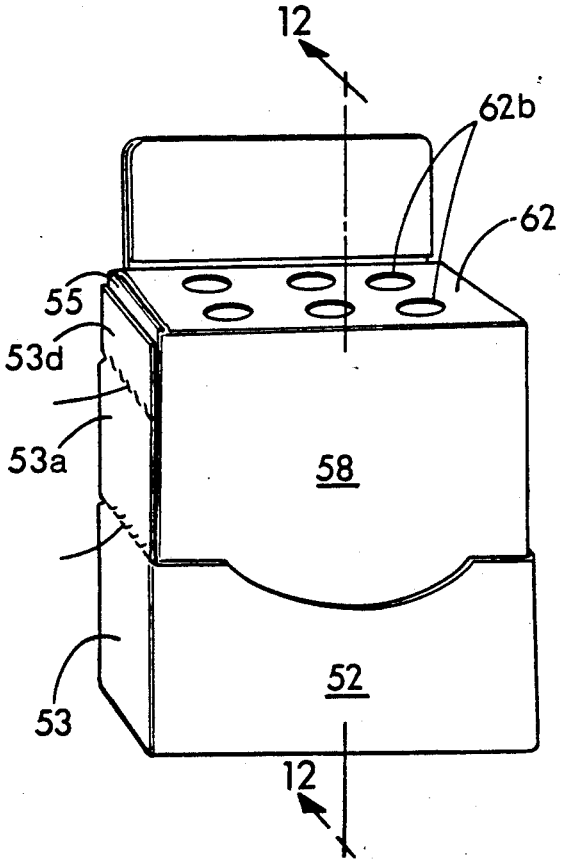
FIG. 9 is a perspective view of the carton as it appears during heating in a microwave oven.
Figure 10:
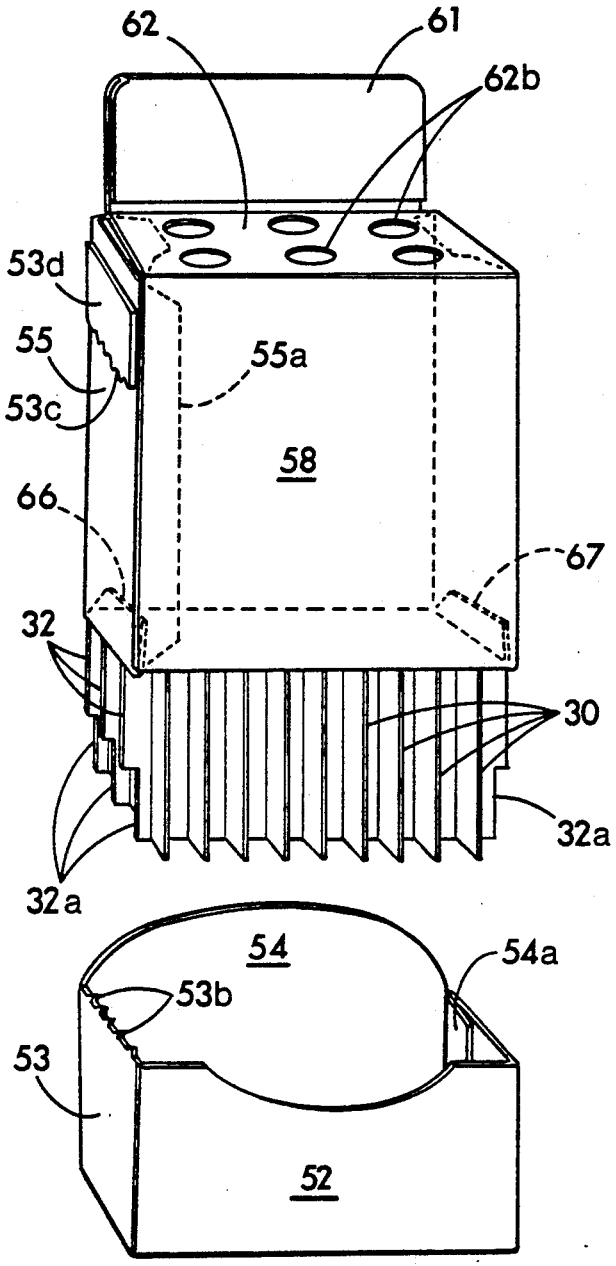
FIG. 10 is a perspective exploded view of the carton.
Figure 13:
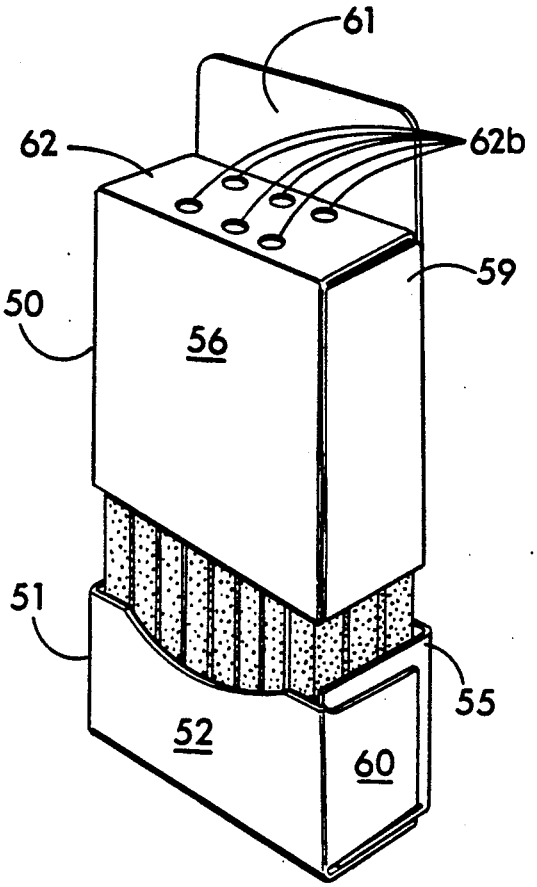
FIG. 13 is a perspective view of the package with the top partially removed.
Figure 14:
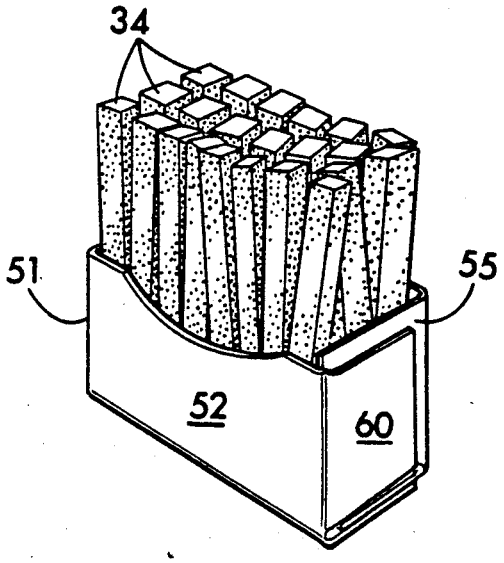
FIG. 14 is a view of the bottom portion of the package functioning as a serving tray with the food product therein.

Refer now to FIGS. 7–15 which illustrate one form of folding carton that can be employed in connection with the invention. As shown in the figures, a flat carton blank composed of two pieces 50 and 51 formed from food grade paperboard is provided with a plurality of side panels 52–60 to form the side walls of the package. Tabs 61, 62 and Ta form the top, and tabs Tb form bottom walls. A tab 54 is bonded to panel 60 to form the bottom portion 51 of the carton, after which tabs Tb are tucked together. A tab 55*a* is bonded by adhesive to side panel 58 to hold the upper portion 50 of the package together as shown in FIG. 10. The panels 52–60 and the tabs Ta and Tb are separated from one another by vertical and horizontal fold lines, as shown. A full length panel 53 is provided with two horizontally extending tear lines 53*b* and 53*c* which provide between them a tear tab or opening tab 53*c*. The portion above line 53*c* is bonded to panel 55 of the top portion of the package after the halves of the package are slid telescopically together as shown in FIGS. 8 and 9. Following heating, the tab 53*a* is lifted, severing tear lines 53*b* and 53*c*. This allows the bottom portion 51 of the carton to be removed as shown in FIGS. 13 and 14. Top flap 62 is provided with a locking tab 62*a* and with steam vent openings 62*b*.

Figure 4:
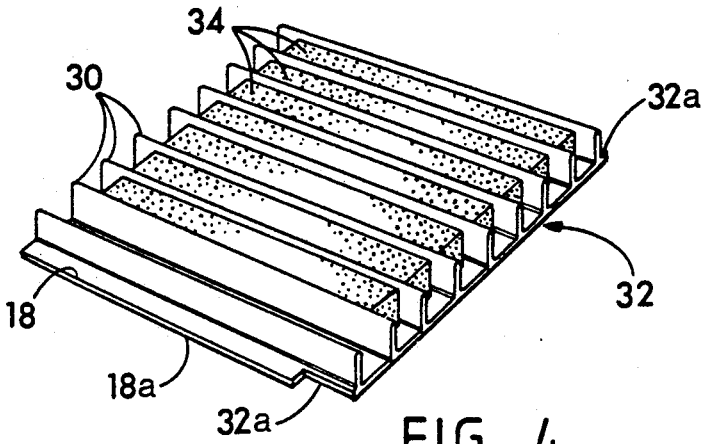
FIG. 4 is a perspective view of one form of laminated tray containing food sticks in accordance with the invention.
Figure 11:
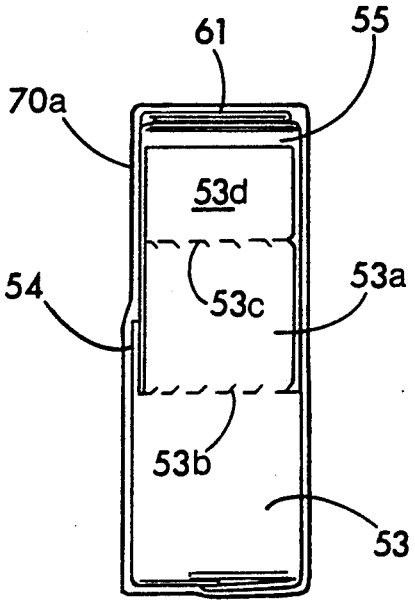
FIG. 11 is a side view taken on line 11—11 of FIG. 8.
Figure 12:
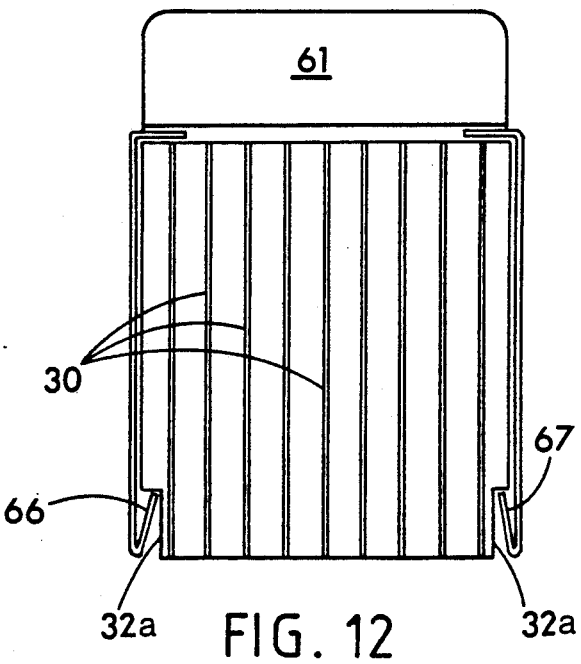
FIG. 12 is a vertical cross-sectional view of the package taken on line 12—12 of FIG. 9.

The stack of trays 32 as well as the sheets 18–18*a* of FIG. 3 are then inserted from either end, either before or after the french fries, fish sticks or other food pieces 34 are placed in the trays 32. In a preferred filling method, the trays 32 are first individually filled by placing the food sticks into the compartments between the partitions as shown in FIG. 4. Trays are then stacked one on top of the other and inserted into the carton. The tabs Ta are folded down, tab 62 is tuck-locked in place and tab 61 is folded forwardly as shown in FIG. 11. Finally, the carton is overwrapped with protective barrier film 70*a* such as polypropylene or saran coated cellophane and sealed. The filled carton is now ready for shipment.

One especially effective method of holding the trays in the carton is the provision of a pair of opposed, centrally folded, upwardly directed tabs 66 and 67 at the lower end of panels 55 and 57 of the top portion 50 of the carton. The tabs 66 and 67 are folded upwardly so as to project up into aligned recesses 32*a* of the trays 32. Since tabs 66 and 67 are directed upwardly, they cooperate with each other to provide a wedging action for holding the trays 32 in place in the upper portion 50 of the carton. In this way the trays 32 will be securely held in place by the tabs 66 and 67 even after the carton is opened.

The carton thus comprises inner and outer telescoping portions 50 and 51, held together by tear tab 53*a*. The height of the upper portion 50 is the same as the carton. The lower portion 51 has a height which is, in the carton shown, about one-half the height of the carton.

The tab 61 is folded over and bonded to itself along a central fold line 61*a* to provide a lifting handle for removing the hot carton from the oven. To keep the tab 61 out of the way, it is folded down against flap 62 and held in place by the overwrap 70*a* (FIGS. 8 and 11). Just prior to heating, the overwrap 70*a* is removed, allowing the lifting tab 61 to return to an upright position (FIG. 9).

Figure 15:
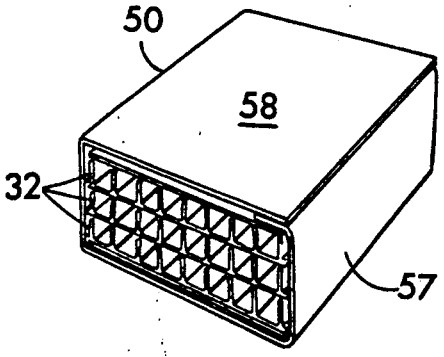
FIG. 15 is a perspective view of the top portion of the package after being removed.

When the carton is to be opened after heating, the tear tab 53*a* is pulled. This allows the entire upper portion 50 of the carton to be separated and raised as shown in FIG. 13 to expose the food sticks 34 which remain in the lower portion 51 of the carton. Lower portion 51 then functions as a serving dish. The upper portion 50 as shown in FIG. 15 holds the trays 32. It can therefore be seen that drawing apart the upper and lower portions 50, 51 of the carton separates the microwave interactive heating laminates of each tray 32 from the food product 34 which remains in place and, as it does so, slides endwise out of the compartments in the trays 32 and remains in the lower portion 51 of the carton where they can then either be eaten directly or placed in a serving bowl or dish.

It should be noted that the compartments for the rectangular food sticks 34 in the trays 32 have a square corner and that the bottom is flat rather than round as in corrugated board or other corrugated partitioning packages. In this way the food product 34 is surrounded and in contact or nearly in contact on at least three sides with the microwave interactive material of the tray 32 in which it rests and on the fourth side by the sheet 18*a* of the sheet above it so that there is a uniform clearance on all major, i.e. elongated, surfaces of the food piece. The food pieces contact or almost contact the compartment walls but each is slidably and removably held in its compartment. The clearance is typically about 1/64 to 1/32 inches or less. During heating in the microwave oven, the partitions 30 will pick up microwave energy and transmit it directly to the surfaces of the food pieces which in the course of heating will be crisped as they are toasted. The holes 62*a* allow the escape of excess steam. In this way the food pieces 34 are toasted, browned and crisped uniformly on at least three and preferably on all four sides.

While the invention is suited for a variety of different kinds of food pieces, it is particularly well suited for use with fabricated food products such as fabricated french fried potatoes prepared from a moist, cooked and mashed potato mass, i.e. potato dough which is molded to rectangular shape shown, cut into pieces of the required length, fried in hot shortenening and then placed in the package.

Many variations of the present invention within the scope of the appended claims will be apparent to those skilled in the art once the principles described above are understood.

What is claimed is:

1. A microwave heating and serving package for food sticks comprising, a carton that is transparent to microwave energy, said carton being composed of two separable carton portions each including a pair of opposing front and rear walls, a pair of side panels on opposite sides thereof, one portion including a top panel and the other portion including a bottom panel, a plurality of partitioned microwave heating trays in the carton, each tray including a plurality of vertically disposed parallel laterally spaced partitions composed of microwave interactive susceptor material, each pair of adjacent partitions being joined by a flat wall composed of susceptor material to thereby provide a honeycomb-like array of open-ended cells formed from microwave receptive susceptor material each containing one of the food sticks, the cells browning or toasting the adjacent surface of the food stick within each cell, retaining members for holding the trays in the carton comprising a pair of centrally folded upwardly directed tabs extending from opposite walls of one portion of said carton, said tabs having portions engaging the trays, the upward inclination of the tabs on opposite sides of the trays cooperating with each other through engagement with the trays to provide a wedging action for holding the trays in place within one portion of the carton.

2. A microwave heating and serving package for food sticks comprising, a carton that is at least partially transparent to microwave energy to allow penetration of microwave energy into the carton for heating the food sticks, said carton being composed of at least one carton portion including a pair of opposing front and rear walls, a pair of opposing side walls, a top panel and an outlet opposite the top panel, said package also having a bottom panel normally covering the outlet opening, said bottom panel being removable to allow the food sticks to be removed from the package by sliding outwardly through the outlet opening after removal of the bottom panel, at least one microwave heating tray within the carton, said tray including a plurality of chambers to contain the food sticks, the tray including microwave interactive susceptor material that absorbs the microwave energy for heating the food sticks to brown or toast the adjacent surfaces of the food sticks, retaining members for holding the tray in the carton comprising a pair of centrally folded upwardly directed tabs extending from the opposing walls of the carton, said tabs having portions engaging the tray, the upward inclination of the tabs on opposite sides of the tray cooperating with each other through engagement with the tray to provide a wedging action for holding the tray in place within the carton.

3. The carton of claim 2 wherein the tray includes recesses and the tabs project into the recesses to thereby engage the tray for holding the tray within the carton when the food sticks are removed therefrom.

4. The carton of claim 2 wherein a plurality of said trays are provided within the carton in stacked relationship.

5. The carton of claim 2 wherein said carton includes an outer carton portion adapted to at least partially enclose said one carton portion and said outer carton portion includes a wall therein comprising said bottom panel and said outer carton portion is separable from said one carton portion to allow removal of said bottom panel from said one carton portion to provide an opening therein for the removal of the food sticks from the carton portion.

6. The carton of claim 2 wherein food sticks are contained therein and the food sticks comprise french fried potatoes.

7. The carton of claim 5 wherein the outer carton portion is a serving tray adapted to receive the food sticks and to hold them while they are being eaten.

* * * * *